US008025835B2

(12) United States Patent
Deka et al.

(10) Patent No.: US 8,025,835 B2
(45) Date of Patent: Sep. 27, 2011

(54) FURNACE CONFIGURED FOR USE IN BOTH THE GALVANNEALING AND GALVANIZING OF A METAL STRIP

(75) Inventors: Mitrajyoti Deka, Crown Point, IN (US); Stavros George Fountoulakis, Schererville, IN (US); Ramachandra S. Patil, Munster, IN (US)

(73) Assignee: ArcelorMittal Investigación y Desarrollo, S.L., Bizkaia (ES)

( * ) Notice: Subject to any disclaimer, the term of this patent is extended or adjusted under 35 U.S.C. 154(b) by 1025 days.

(21) Appl. No.: 11/850,714

(22) Filed: Sep. 6, 2007

(65) Prior Publication Data

US 2009/0031950 A1 Feb. 5, 2009

Related U.S. Application Data

(60) Provisional application No. 60/952,958, filed on Jul. 31, 2007.

(51) Int. Cl.
*C21D 9/54* (2006.01)

(52) U.S. Cl. ..... 266/103; 266/252

(58) Field of Classification Search ..... 266/103, 266/252

See application file for complete search history.

(56) References Cited

U.S. PATENT DOCUMENTS

| | | | | |
|---|---|---|---|---|
| 4,326,342 | A * | 4/1982 | Schregenberger | 34/538 |
| 5,628,842 | A | 5/1997 | Wilmotte et al. | |
| 6,428,851 | B1 | 8/2002 | Friedersdorf et al. | |
| 6,902,829 | B2 | 6/2005 | Pradhan et al. | |

FOREIGN PATENT DOCUMENTS

| | | | |
|---|---|---|---|
| EP | 0047063 | A | 3/1982 |
| JP | 57043937 | A | 3/1982 |
| JP | 60-159159 | A | 8/1985 |
| JP | 60149759 | A | 8/1985 |
| JP | 2-194157 | A | 7/1990 |
| JP | 5-156419 | A | 6/1993 |
| JP | 6-93340 | A | 4/1994 |
| JP | 8-13046 | A | 1/1996 |
| JP | 2003-64421 | A | 3/2003 |
| JP | 2004-2913 | A | 1/2004 |
| JP | 2004-307904 | A | 11/2004 |
| KR | 2004-055985 | A | 6/2004 |

OTHER PUBLICATIONS

International Search Report issued in corresponding International Application, Oct. 14, 2008, 3 pages.

* cited by examiner

*Primary Examiner* — Scott Kastler
(74) *Attorney, Agent, or Firm* — Baker & Daniels LLP

(57) ABSTRACT

A heat treatment or heat soak furnace for use in both galvannealing and galvanizing processes including a heating apparatus configured to supply heat and remove heat. The heating apparatus may draw hot air from the exhaust of a direct fire strip annealing furnace, gas burners or electric heat exchangers as necessary. The furnace also may include a plurality of cooling mechanisms in order to ensure heat is removed and the temperature within the furnace regulated. In addition, the furnace may include baffles configured to allow portions of the interior of the furnace to be separated into different temperature zones. The furnace under this invention is capable of providing a suitable thermal environment for a desired time, duration, for steel sheet substrates with different chemistries, different coating thicknesses and different process speeds to achieve an optimum phase microstructure of the galvannealed, zinc-iron alloy coating; or to promptly solidify the galvanizing unalloyed zinc coating so that it has a high quality surface morphology.

18 Claims, 3 Drawing Sheets

FURNACE CONFIGURED FOR USE IN BOTH THE GALVANNEALING AND GALVANIZING OF A METAL STRIP

BACKGROUND OF THE INVENTION

1. Field of the Invention

The present invention relates to the processes of galvanizing and galvannealing a metal strip. Specifically, the present invention relates to a soak furnace capable of being used for after pot cooling in the galvanizing of a metal strip and for heat treatment of the zinc coated strip to complete the alloying in the galvannealing of a metal strip. The soak furnace allows for various adjustments in the soak time and temperature conditions of the strip in order to optimize the galvanneal coating phase compositions for a wide variety of steel grades.

2. Description of the Prior Art

In a galvannealing process, a zinc coating may be deposited on a steel strip. The zinc coated strip may then be heated in an alloying furnace in order to form a zinc alloy and then may be further heated in a soak furnace in order to complete the alloying process. In general, it is desirable for the galvannealed coating to include primarily a delta microstructure and avoid zeta and gamma phases. The greater the amount of gamma phase in the coating, the greater the chance that the coating will be too brittle, and the greater the amount of zeta phase in the coating, the more likely that the coating will be too soft. In general, excessive gamma phase may be formed when the strip is heat treated within the soak furnace for too long a time and/or at too high a temperature. Conversely, zeta phase may be formed when the strip soaks within a soak furnace at too short a time and/or at too low a temperature.

In order to optimize galvanneal coating phase composition for a variety of steel grades with a variety of coating thicknesses, one may optimize the soaking temperature and duration of the strip in the soaking environment. When the soak furnace is of a fixed length, generally it is not possible to adjust the soak duration without potential loss in productivity. Soaking furnaces without adequate supply of hot and cold air cannot maintain a desired thermal profile during the strip's transition through the furnace. Therefore, a soaking furnace capable of providing desired thermal environment for a desired time (duration) for substrates with different chemistries, different coating thicknesses and different process speeds is essential. This invention has been designed to overcome these shortcomings of soak furnaces with a fixed length and inadequate thermal atmosphere control.

U.S. Pat. No. 6,428,851 discloses a bath configured to allow for the thermal depositing of a coating onto a moving metal web. The process disclosed may be used for the priming of zinc and zinc-alloy coated steel webs. The disclosed process utilizes air nozzles to maintain the position and stability of the web as the web moves through a curing oven. Mist jets and blowers are used to cool the moving web prior to contacting a turner roll Korean Patent Publication 2004055985 discloses a method for controlling the temperature and composition of atmospheric gas in the soaking zone of a galvannealing furnace. The disclosed method includes the steps of arranging atmospheric gas injection and sealing means on the inner lower side of a vertical soaking zone; passing mixed gas through a suction ejector; injecting the mixed gas using a blower; and injecting a second mixed gas into the soaking zone through a gas injection and sealing means. The first mixed gas comprises atmospheric gas and atmospheric composition adjusting gas, the latter previously mixed in intermediate step. A mixture of nitrogen and hydrogen or air may be used as the furnace atmosphere adjusting gas. The second mixed gas comprises first mixed circulation atmospheric gas and also combustion flue gas generated from a combustion chamber. The combustion chamber may be separately installed on the outside of the soaking zone. An air injection sealing means may be arranged on the upper part of the soaking zone, and the injection sealing means may suppress the outflow of atmospheric gas from an upper part of the soaking zone in order to cool the atmospheric gas and at the same time connect the air injection sealing means with the gas injection sealing means. According to this invention, the thermal soak profile is controlled by introducing cool gas in the lower part of the soak chamber and hotter gas in the upper part of the soak chamber to achieve the desired galvanneal powdering resistance. But the shortcoming of this method is that it cannot provide the flexible soak profile that is needed for a wide variety of steels because it cannot control the soak time at temperature due to the absence of separate soak zones divided by internal baffles.

Japanese Patent Publication 2003064421A generally discloses a processing apparatus for a steel strip in a continuous annealing furnace but not in a galvanneal soak furnace. The processing apparatus includes slidable baffle plates arranged on the right and left edges of the strip. The baffle plates alter the gap in the edges of the apparatus thereby varying the flow of coolant through the apparatus. The patent discloses arranging a pair of spray boxes in front of and behind a steel strip. The flow of coolant from the spray box is altered by adjusting the gap defined by the baffle plates. A difference in pressure may be generated with respect to the surfaces of the strip by adjusting the flow of the coolant. The baffle plates may be moved orthogonally with respect to the opposing surface of the spray boxes. In addition, the patent discloses that the spray box may be used to either cool or to dry the steel strip.

Japanese Patent Publication No. 2004307904A discloses a steel strip cooling device for a continuous annealing furnace but not for galvanneal soak furnace. The cooling device includes baffle plates arranged at predetermined intervals between projecting gas ejection nozzles connected to a pair of opposing cooling plates. The baffle plates may be arranged along the conveyance path of the steel strip. In addition, the cooling device may be used for a continuous annealing furnace and a zinc galvanizing furnace but not for galvanneal soak furnace. In addition, the device provides for the retention of gas near the edges of the steel strip and the flap of the steel strip, thereby improving the efficiency of the furnace.

SUMMARY OF THE INVENTION

An embodiment of the present invention includes a furnace for soaking a strip during a galvannealing or for after pot cooling during a galvanizing process. The furnace includes a chamber defined by four walls, a first opening and a second opening. In addition, the furnace may include first and second heating inputs capable of delivering heated gas (e.g. N2, H2, air, etc.) into the interior and first and second inputs capable of delivering cooled gas into the interior. The furnace may also include a first set of baffles.

In embodiments of the invention, the first set of baffles is located between the first heat input and the second heat input. In addition, the first set of baffles may be infinitely adjustable between a substantially open position and a substantially closed position.

In embodiments, the furnace may include a first set of adjustable doors capable of substantially covering the first opening and a second set of adjustable doors capable of covering the second opening. In addition, the furnace may further include a third heat input capable of delivering heated gas into the interior and a fourth heat input capable of delivering heated gas into the interior. Furthermore, the furnace may further include a second set of baffles. The first set of baffles may be located between the first heat input and the second heat input, and the second set of baffles may be located between the first heat input and the second set of adjustable doors In embodiments, the furnace may further include a fan and four valves. The fan may force the heated gas into the chamber, and each of the valves may be coupled to one of the inputs. The valve may be configured to control the amount of heated gas that enters the chamber through the inputs. In embodiments, the furnace may further include a first heat exchanger configured to heat the gas. In other embodiments, the furnace may include a second heat exchanger configured to heat the gas. In addition, in embodiments, the heated gas is supplied to the fan by a direct fire furnace.

In embodiments, the second set of baffles may be adjustable between a substantially open position and a substantially closed position. In embodiments, each of the four heat inputs may define a zone in the interior, and the first zone may be located near the first opening. In addition, the fourth zone may be located near the second opening. Furthermore, the first set of baffles may be located in the third zone, and the second set of baffles may be located in the fourth zone.

In embodiments, the furnace further includes a first cooling apparatus capable of directing cool gas into the interior. In embodiments, the furnace further may include a second cooling apparatus capable of directing cool gas into the interior, and the furnace may include a third cooling apparatus capable of directing cool gas into the interior. Furthermore, in embodiments of the invention, each of the cooling apparatuses may include a fan, an input capable of allowing cool gas into the interior, a valve capable of regulating the flow of cool air or other gas into the interior, and a conduit connecting the fan to the input. The valve may be connected to the conduit. In addition, in embodiments, the first, the second and the third cooling apparatuses may inject cool air or other gas into the fourth zone of the interior.

An embodiment of the invention includes a furnace used for alloying in a galvannealing or for after pot cooling in a galvanizing process. The furnace may include a chamber defined by four walls, a first opening and a second opening. In addition, the furnace may include a hot air/gas apparatus including a fan, at least one hot air or gas heating apparatus, conduit including an input, and a plurality of valves. Each of the valves may be connected to a portion of the conduit, and the input may be connected to the chamber. In addition, the valves may control the amount of hot air or gas passing through the conduit. Furthermore, in embodiments, each of the inputs may define a zone in the interior portion. The furnace may also include a first pair of baffles and a second pair of baffles. The first pair of baffles may be located in one zone located near the first opening, and the second pair of baffles may be located in another zone. The latter zone may be located adjacent to the first zone. In addition, the first pair of baffles and the second pair of baffles may be infinitely adjustable between a substantially closed position and a substantially open position.

BRIEF DESCRIPTION OF THE DRAWINGS

The above-mentioned and other features of this invention and the manner of obtaining them will become more apparent and the invention itself will be better understood by reference to the following description of embodiments of the present invention taken in conjunction with the accompanying drawings, wherein.

Figure 1:
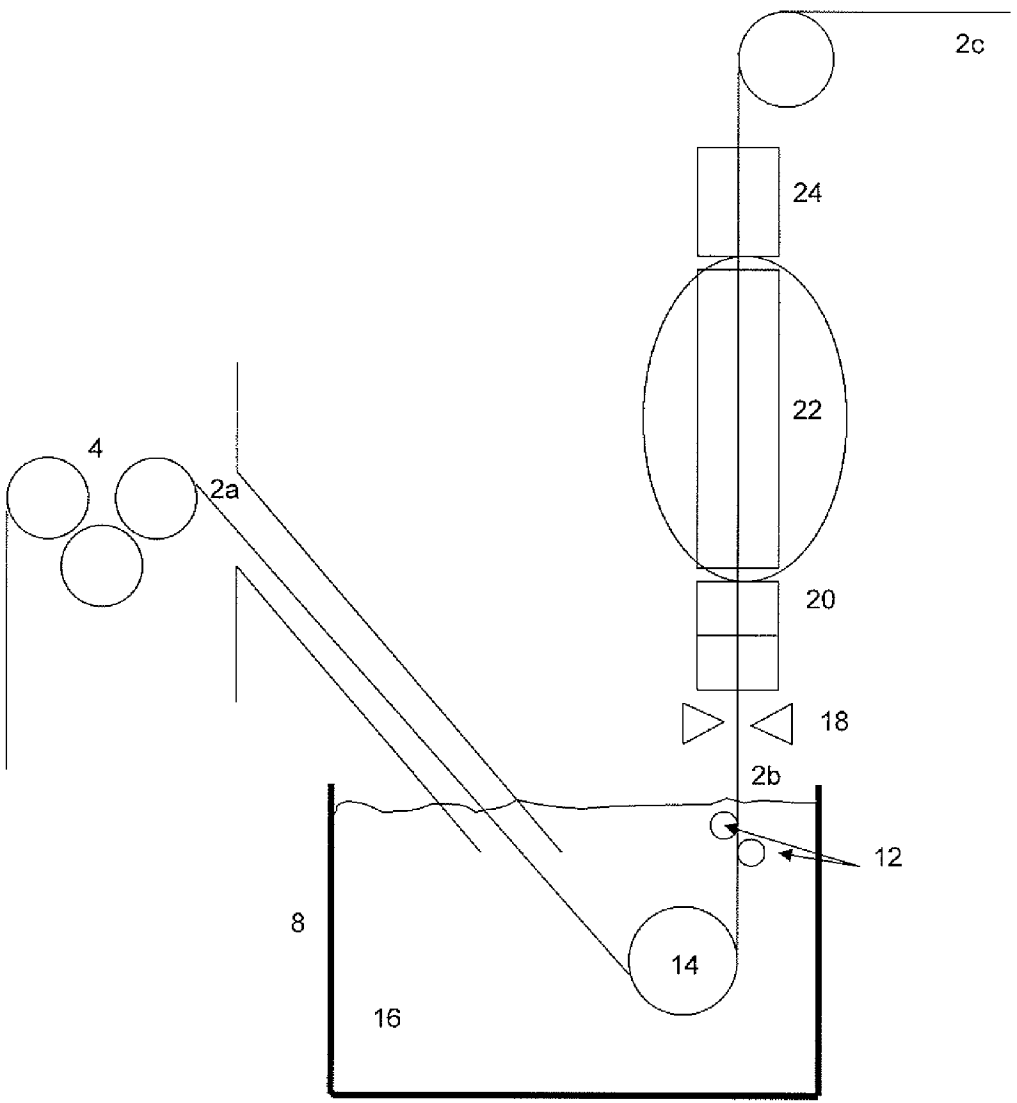
FIG. 1 is a diagram outlining a representative galvannealing process.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF EMBODIMENTS OF THE INVENTION

For the purposes of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

FIG. 1 depicts an embodiment of a galvannealing process according to the present invention. In the depicted embodiment, numeral 2*a* indicates a metal strip or web that is to be coated in the described process. The strip 2*a* travels over a bridle 4 downward into a tank, generally indicated by numeral 8. Tank 8 includes sink roll 14, and a pair of stabilizer roll and correcting roll 12. Tank 8 contains a bath of molten zinc, generally indicated by numeral 16, for coating the strip 2*a*. The molten zinc contained within the bath may be kept in the molten state in any suitable manner.

As depicted in FIG. 1, an uncoated portion of the strip 2*a* travels downward into the zinc bath 16, around roller 14 and upward through stabilizer roll and correcting roll pair 12. Upon exiting zinc bath 16, the coated strip, indicated by numeral 2*b*, generally passes between nozzles, indicated by numeral 18. The nozzles 18 direct any suitable gas toward the strip 2*b*, such as air or nitrogen, for example, to maintain the position and stability of the strip 2*b* as it travels upwards from the zinc bath 16. In addition, the air or nitrogen may be used to remove excess molten zinc and control the coating thickness of the zinc on the strip 2*b* following the exit of the strip 2*b* from the zinc bath 16.

The strip 2*b* travels through an alloying furnace, generally indicated by numeral 20. The alloying furnace 20 heats the strip 2*b* to a suitable temperature, generally between 860° F. and 1194° F. (460° C. and 590° C.), to ensure that the zinc reacts with the metal strip 2*b*. For example, in embodiments wherein the metal strip 2*b* is formed from steel, strip 2*b* may be heated to a temperature sufficient to cause the zinc coating to react with the steel in order to form a zinc-iron alloy.

It should be noted that in embodiments of the invention in which strip 2*b* is galvanized, the strip 2*b* need not run through the alloying furnace 20. Instead, once the excess molten zinc from the zinc bath 16 has been removed by the nozzles 18, the strip 2*b* may bypass the alloying furnace 20 in any suitable manner. Alternatively, strip 2*b* may pass through alloying furnace 20, but the furnace 20 may be turned off so that it does not heat the strip 2*b*, or the furnace moved altogether off the path of the strip.

After strip 2*b* either exits or bypasses alloying furnace 20 (depending on the process), it is routed into soak furnace 22. As explained in detail below, soak furnace 22 is configured to provide a desired thermal treatment to the strip in order to complete either a galvannealing or galvanizing process. With temperature regulation, soak furnace 22 controls the thermal treatment of the zinc/zinc alloy that coats the strip 2*b*. Once the strip 2*b* has exited the soak furnace 22, the strip 2*b* travels into a final cooler 24. The final cooler 24 cools the strip 2*b*, and the cooled strip 2*c* travels around a roller 26. It should be noted that in embodiments of the invention, the final cooler 24 depicted in FIG. 1 may be replaced with multiple coolers as desired or necessary. Similarly, the nozzles 18 depicted as a pair of nozzles in FIG. 1, may be replaced with multiple nozzles as desired or necessary.

It should be noted that FIG. 1 depicts a generalized view of a galvannealing process and the description above relates to generalized galvannealing and galvanizing processes. With respect to the majority of the elements depicted in FIG. 1 and described above, any suitable elements known in the art may be utilized in the processes.

Figure 2:
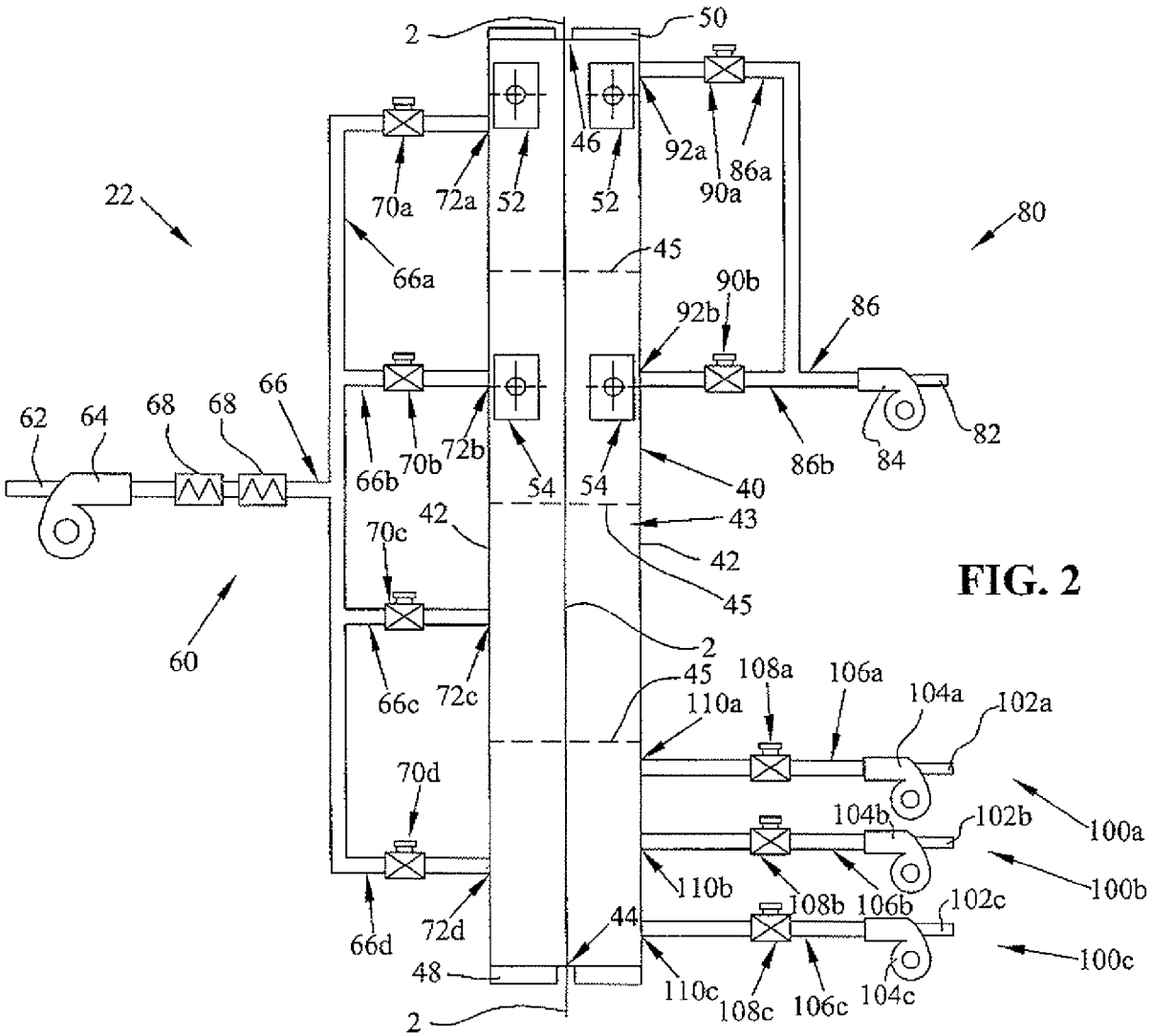
FIG. 2 is a diagrammatical view of a furnace representing an embodiment of the present invention.

FIG. 2 depicts a soak furnace, generally indicated by numeral 22, according to one embodiment of the present invention. Soak furnace 22 includes a plurality of walls 42, a first opening, generally indicated by numeral 44, and a second opening, generally indicated by numeral 46. It should be noted that FIG. 2 depicts a section view of soak furnace 22, and soak furnace 22 generally includes four walls 42. The four walls 42 define a chamber, generally indicated by numeral 43. In the depicted embodiment, the strip 2*b* generally enters furnace 22 through first opening 44 and exits furnace 22 through second opening 46. Furnace 22 further includes doors 48 positioned near first opening 44 and doors 50 positioned near opening 46. Doors 48, 50 may be opened or substantially closed either manually or by an automatic mechanism.

Furnace 22 further includes a first set of baffles, generally indicated by numeral 54, and a second set of baffles, generally indicated by numeral 52. In the depicted embodiment of the invention, baffles 52, 54 may be moved from a substantially opened position wherein the baffles 52, 54 extend substantially vertically, to a substantially closed position wherein the baffles 52, 54 extend substantially horizontally. In FIG. 2, solid lines represent the baffles 52, 54 in the substantially open position and the phantom lines represent the baffles 52, 54 in the substantially closed position.

In the substantially open position, the baffles 52, 54 allow heated air present within chamber 43 of the furnace 22 to move freely throughout the chamber. When the baffles 52, 54 are arranged in the substantially closed position, however, they restrict movement of the air, thereby allowing certain areas of the chamber 43 to be maintained at a temperature differing from the temperature of other portions of the chamber 43. It should be noted that the baffles, 52, 54 may be orientated at an infinite number of positions between the substantially fully open position and the substantially fully closed position. Furthermore, it should be noted that the heated air may be replaced with any suitable gas.

In the depicted embodiment, furnace 22 further includes a heating mechanism, generally indicated by numeral 60. The heating mechanism 60 includes an input 62 connected to a fan mechanism 64. The exhaust of fan mechanism 64 is connected to the interior 43 of furnace 22 by way of conduit generally indicated by numeral 66. In the depicted embodiment, heating mechanism 60 may include a plurality of heat exchangers 68. Heat exchangers 68 may be any suitable heat exchanger capable of heating air being passed through the heating apparatus 60. The depicted embodiment of the heating apparatus 60 includes two heat exchangers 68.

In the depicted embodiment, conduit 66 is divided into four sections, each indicated by numerals 66*a*, 66*b*, 66*c* and 66*d*, respectively. Each of the sections of conduit 66*a*, 66*b*, 66*c*, 66*d* include a valve, indicated by numerals 70*a*, 70*b*, 70*c* and 70*d*, respectively. The four sections of conduit 66*a*, 66*b*, 66*c*, and 66*d* are connected to the chamber 43 by inputs, indicated by 72*a*, 72*b*, 72*c* and 72*d*, respectively.

In the depicted embodiment, the heating apparatus 60 is configured to provide heated air to chamber 43. This is achieved in one embodiment of the invention by connecting input 62 to the exhaust from a direct fire strip anneal furnace (not shown) or alternatively a burner (not shown) thereby allowing substantially heated air to be fed into fan 64. In addition, if the air propelled by fan 64 into conduit 66 is not of a sufficient temperature, heat exchangers 68 may be utilized to further increase the temperature of the air. The heated air may be fed into chamber 43 through any of the inputs 72 as desired. Valves 70 may be adapted to control the amount of heated air fed into chamber 43 through the inputs 72. It should be noted that in the depicted embodiment of furnace 22, each of the inputs 72 generally feed air at substantially the same temperature. For discussion purposes, each of the inputs 72 defines a zone, each delineated by a hash line generally indicated by numeral 45 in FIG. 2. Since the heating apparatus 60 includes four inputs 72 the interior 43 of the furnace 22 includes four zones.

Referring still to FIG. 2, in the depicted embodiment, numeral 80 indicates a cooling apparatus. Cooling apparatus 80 has a configuration similar to heating apparatus 60. Cooling apparatus 80 includes an input 82 and a fan 84. Conduit 86 is connected to the exhaust of the fan 84. Conduit 86 has two sections 86*a*, 86*b*. Each section of conduit 86*a*, 86*b* flows through a valve 90*a*, 90*b*, respectively, and enters the chamber 43 via inputs 92*a*, 92*b*, respectively. It should be noted that in the depicted embodiment, the inputs 92*a*, 92*b* are arranged to enter chamber 43 in the same zones as the inputs 72*a*, 72*b* of the heating apparatus 60. The cooling apparatus 80 forces relatively cool air into the interior 43. In the depicted embodiment, input 82 of the cooling apparatus 80 generally draws from ambient air with the understanding that the ambient air temperature would generally be below that of the air present within the chamber 43 and the air forced into the chamber 43 by heating apparatus 60. In a manner similar to valves 70 of the heating apparatus 60, the valves 90*a*, 90*b* of the cooling apparatus 80 each control the amount of cool air entering the interior 43 through each of the inputs 92*a*, 92*b* respectively.

In the depicted embodiment, furnace 22 further includes a plurality of pre-coolers, each indicated by numerals 100*a*, 100*b* and 100*c*. Pre-coolers 100*a*, 100*b*, 100*c* each have a configuration similar to cooler 80 described above. Each of the pre-coolers 100 includes an input 102 capable of drawing ambient air. The input 102 feeds a fan 104 connected to the chamber 43 by conduit 106*a*, 106*b* and 106*c*. A valve 108*a*, 108*b* and 108*c* controls the flow of air through the conduit 106, and the conduit 106 includes an input 110*a*, 110*b* and 110*c* that allow air to enter chamber 43. In the depicted embodiment, each of the pre-coolers 100 is located in a single zone. It should be noted that in the depicted embodiment the inputs 110 of the pre-coolers 100 are configured so as to ensure that the air directed into chamber 43 from the pre-coolers 100 may enter at a substantially decreased pressure relative to the air entering through inputs 92 in the cooling apparatus 80. It should be noted that in embodiments of the invention wherein furnace 22 is utilized in a galvanizing process, the decrease of the pressure of the relatively cooler air entering chamber 43 through the inputs 110 of the pre-coolers 100 may be necessary so as not to blow the zinc coating from strip 2*b* up strip 2*b* entering the furnace 22.

During operation of furnace 22, baffles 52, 54, heating apparatus 60, cooling apparatus 80 and pre-coolers 100 may be controlled in any suitable manner. For example, suitable thermocouples (not shown) and suitable controllers (not shown) may be connected in a suitable fashion. The controllers, in turn, may be connected to the heating apparatus 60, cooling apparatus 80 and pre-coolers 100, in a suitable manner. When the thermocouples determine that the temperature of one of the zones in the chamber 43 falls outside a prescribed range, the controllers may activate the heating apparatus 60, the cooling apparatus 80 and the pre-coolers 100, as necessary. Moreover, the baffles 54, 52 may be arranged in various configurations to create different temperature regions in the interior, by opening or closing the baffles 54, 52, and doors 48 and 50, as necessary.

FIGS. 3*a* through 3*f* depict six distinct galvannealing cycles which may be run in furnace 22 described above and depicted in FIG. 2. In each of the curves, the portion indicated by "A" represents heating achieved by the heating of the strip 2 by the alloying furnace 20 of FIG. 1. The portion "B" represents the soaking that may be achieved by the soak furnace 22 of FIG. 2. It should be noted that the configuration of the soak furnace 22, and the heating and cooling of the furnace may be altered based upon the configuration of the furnace. The portion "C" of the curves in FIGS. 3*a* through 3*f* represents some examples of the cooling achieved by the final air coolers 24 of FIG. 1.

Figures 3A, 3B, 3C, 3D, 3E, 3F:
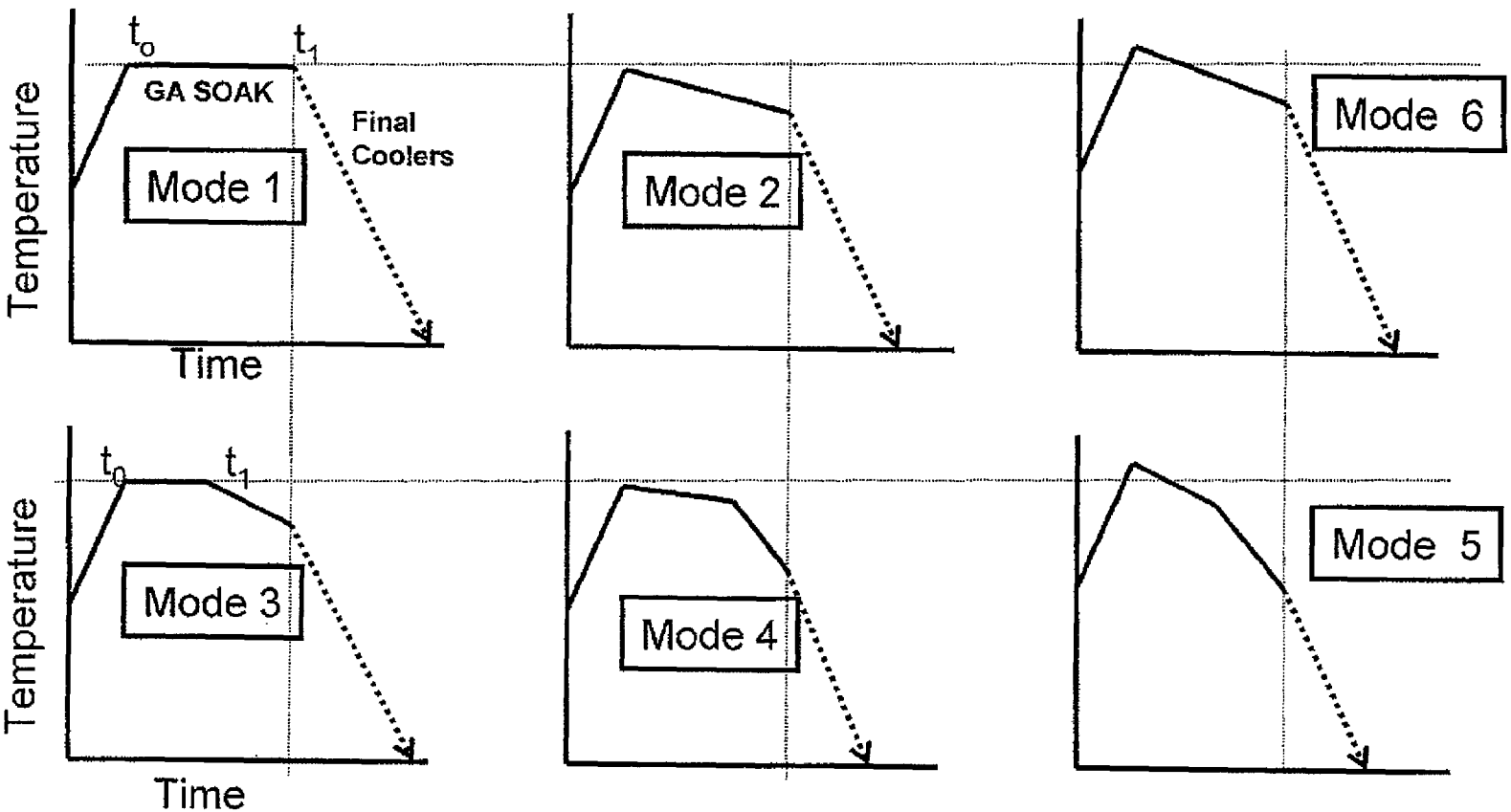
FIGS. 3*a* through 3*f* are a series of temperature versus time graphs representative of various galvannealing modes that may be carried out with the furnace depicted in FIG. 2.

It should be noted that the various time vs. temperature profiles achieved by the soak furnace 22 may be achieved by altering the positions of the baffles 54, 52 and controlling the hot air input and cool air input into the chamber interior 43 by way of the heating apparatus 60 and cooling apparatus 80 and pre-coolers 100, respectively. For example, in FIG. 3*a*, soak furnace 22 may be configured to provide constant temperature throughout the furnace 22. In FIGS. 3*b* and 3*c*, furnace 22 is configured so that each successive zone has a temperature less than the previous zone. In FIG. 3*d*, a portion of the furnace 22 has a constant temperature and a portion of the furnace 22 has zones at temperature less than the previous zone. In FIGS. 3*e* and 3*f*, furnace 22 is configured so that each zone has a temperature less than the previous zone, but the difference between each zone varies. FIGS. 3*a* through 3*f* represent examples of temperature versus time curves that may be achieved with furnace 22.

With the ability to control the temperature within the chamber 43 and the ability to divide the chamber 43 with the baffles 54, 52, the soak furnace 22 may substantially eliminate the formation of a zeta phase in the coating of the strip 2 and minimize the thickness of the gamma interfacial layer in the strip 2*b*, thereby ensuring that a majority of the coating thickness consists of a delta phase microstructure.

In a galvanizing process, as the strip 2*b* enters the furnace 22, the pre-coolers 100 are activated to cool the zinc coating on the strip 2*b* and solidify it almost immediately. Accordingly, in such an example, valve 70*a*-70*d* may be substantially closed thereby ensuring almost no warm air enters chamber 43 through inputs 72*a*-72*d* of heating apparatus 60. Moreover, the cool air being supplied by the pre-coolers 100 may be supplied at a relatively lower pressure in order to ensure the pre-coolers 100 do not blow the zinc coating from the strip 2*b*. The remainder of the interior 43 may also be used to cool the zinc coating using cooling apparatus 80 in order to complete the galvanizing process.

While the invention has been taught with specific reference to these embodiments, one skilled in the art will recognize that changes can be made in form and detail without departing from the spirit and scope of the invention. The described embodiments are to be considered, therefore, in all respects only as illustrative and not restrictive. As such, the scope of the invention is indicated by the following claims rather than by the description.

The invention claimed is:

1. A furnace for use in a galvannealing or a galvanizing process including:

a chamber including multiple zones defined by four walls, a first opening and a second opening;

a first heating input capable of delivering warmed gas into a first zone of the chamber;

a second heating input capable of delivering warmed gas into a second zone of the chamber;

a first cooling input capable of delivering cooled gas into one zone of the chamber;

a second cooling input capable of delivering cooled gas into another zone of the chamber;

a first set of baffles positioned in the chamber and moveable between a substantially open position and a substantially closed or partially closed position;

a first set of adjustable doors capable of substantially covering the first opening and a second set of adjustable doors capable of substantially covering the second opening; and a third heating input capable of delivering warmed gas into the chamber and a fourth heating input capable of delivering warmed gas into the chamber, and wherein each of the heating and cooling inputs are separate from one another and attach directly to the chamber, and separate fans are provided for the warmed gas and the cooled gas.

2. The furnace as set forth in claim 1 wherein the first set of baffles is at least partially located between the first heating input and the second heating input.

3. The furnace as set forth in claim 1 wherein the first set of baffles is adjustable between a substantially open position and a substantially closed position in order to define different temperature regions within the chamber.

4. The furnace as set forth in claim 1 wherein the first set of baffles is located between the third heating input and the second heating input and further including a second set of baffles located between the first heating input and the second set of adjustable doors.

5. The furnace as set forth in claim 1 further including a fan and four valves, the fan configured to direct the warmed gas into the chamber and each of the valves being coupled to one of the inputs, the valves being configured to control the amount of warmed gas that enters the chamber through the inputs.

6. The furnace as set forth in claim 5 further including a first gas burner configured to heat the warmed gas.

7. The furnace as set forth in claim 6 further including a second gas burner configured to heat the warmed gas.

8. The furnace as set forth in claim 5 further including a first electric heat exchanger configured to heat the warmed gas.

9. The furnace as set forth in claim 8 further including a second electric heat exchanger configured to heat the warmed gas.

10. The furnace as set forth in claim 5 wherein the warmed gas is supplied to the fan by a direct fire strip annealing furnace.

11. The furnace as set forth in claim 4 wherein the second set of baffles is adjustable between an open position and a closed or partially closed position.

12. The furnace as set forth in claim 10 wherein each of the four heating inputs defines a zone in the chamber with the first zone is located near the first opening and the fourth zone is located near the second opening and the first set of baffles is located in the third zone.

13. The furnace as set forth in claim 12 wherein the second set of baffles is located in the fourth zone.

14. The furnace as set forth in claim 1 further including a first cooling apparatus capable of directing cool gas into the chamber.

15. The furnace as set forth in claim 14 further including a second cooling apparatus capable of directing cool gas into the chamber.

16. The furnace as set forth in claim 15 further including a third cooling apparatus capable of directing cool gas into the chamber.

17. The furnace as set forth in claim 16 wherein the inputs of the first, the second and the third cooling apparatuses are located in a zone defined by the fourth heating input.

18. The furnace as set forth in claim 14 wherein the cooling apparatus includes a fan, an input capable of allowing cool gas into the chamber, a valve capable of regulating the flow of cool air into the chamber, and a conduit connecting the fan to the input, the valve being connected to the conduit.

* * * * *